US005420676A

United States Patent [19]

Arcaro

[11] Patent Number: 5,420,676

[45] Date of Patent: May 30, 1995

[54] ELECTROPHOTOGRAPHIC PRINTER HAVING CAM-OPERATED TRANSFER ROLLER AND DEVELOPER MODULE

[75] Inventor: David J. Arcaro, Boise, Id.

[73] Assignee: Hewlett-Packard Company, Palo Alto, Calif.

[21] Appl. No.: 271,605

[22] Filed: Jul. 7, 1994

[51] Int. Cl.[6] ..... G03G 15/14

[52] U.S. Cl. ..... 355/271; 355/273; 355/277; 355/326 R

[58] Field of Search ..... 355/271, 272, 273, 277, 355/200, 210, 245, 326 R, 327

[56] References Cited

U.S. PATENT DOCUMENTS

| | | | |
|---|---|---|---|
| 5,051,783 | 9/1991 | Sato | 355/271 |
| 5,235,383 | 8/1993 | Tada et al. | 355/200 |
| 5,276,479 | 1/1994 | Inomata | 355/200 |

*Primary Examiner*—Matthew S. Smith

[57] ABSTRACT

An EP printer include a photoconductor-coated drum which has, at its respective ends, a pair of cam plates. Each of the cam plates is provided with plural cam paths, at least a pair of which are employed to control both squeegee and developer rollers within adjacently positioned plural color toner developer modules. A pair of additional cam paths on the cam plates, in combination with link arms and spring-biased follower mechanisms, enable selective engagement and disengagement of a transfer roller with the photoconductor surface so as to enable transfer of a toned image to a media sheet.

10 Claims, 10 Drawing Sheets

ELECTROPHOTOGRAPHIC PRINTER HAVING CAM-OPERATED TRANSFER ROLLER AND DEVELOPER MODULE

FIELD OF THE INVENTION

This invention relates to electrophotographic (EP) printers and, more particularly, to a cam mechanism for controlling engagement and disengagement of an image transfer roller from the EP printer photoconductor and for further controlling operation of liquid toner developer modules.

BACKGROUND OF THE INVENTION

Presently, EP printers that are capable of reproducing color images tend to employ organic photoconductor (OPC) belts, with plural developer stations arrayed along the OPC belt's travel path. Each developer module is associated with a mechanism that enables it to engage the OPC belt so as apply a liquid color toner to image-exposed regions on the OPC belt. Such an EP color printer requires a belt tensioning mechanism and a belt position sensor to assure proper orientation of the belt in relation to a scanned laser beam writing station.

Image transfer from an OPC belt is generally via an image transfer roller/pressure roller combination which is selectively brought into engagement with the OPC belt once the belt has been fully toned with cyan (C), magenta (M), yellow (Y) and black (K) toning solutions. As known to those skilled in the art, a color EP printer employing an OPC belt requires four complete revolutions of the belt through the developer stations so that each developer station can be independently operated to apply its particular color toner to the OPC belt surface. Some EP color printers transfer an applied toner to a media sheet after each individual color toner is deposited on the OPC belt, while others superimpose the color toners on previously toned areas of the belt so as to achieve a full color image on the OPC belt. The fully toned image is then transferred to a media sheet in a single step.

Such color EP printers thus employ many parts for moving various portions of the printer into and out of engagement with the OPC belt. Each separate operating mechanism adds cost to the EP printer and is a source of potential malfunction.

Accordingly, it is an object of this invention to provide an EP printer with a simplified mechanism for enabling engagement between an image transfer roller mechanism and a photoconductor surface.

It is another object of this invention to provide an improved EP printer wherein the same mechanism that enables movement of an image transfer roller further controls engagement and disengagement of liquid toner developer modules.

It is yet another object of this invention to provide a color EP printer wherein a single actuating mechanism enables engagement of each of a plurality of color developer modules with a drum-shaped photoconductor surface.

SUMMARY OF THE INVENTION

An EP printer include a photoconductor-coated drum which has, at its respective ends, a pair of cam plates. Each of the cam plates is provided with plural cam paths, at least a pair of which are employed to control both squeegee and developer rollers within adjacently positioned plural color toner developer modules. A pair of additional cam paths on the cam plates, in combination with link arms and spring-biased follower mechanisms, enable selective engagement and disengagement of an image transfer roller with the photoconductor surface to enable transfer of a toned image to a media sheet.

DETAILED DESCRIPTION OF THE INVENTION

Figure 1:
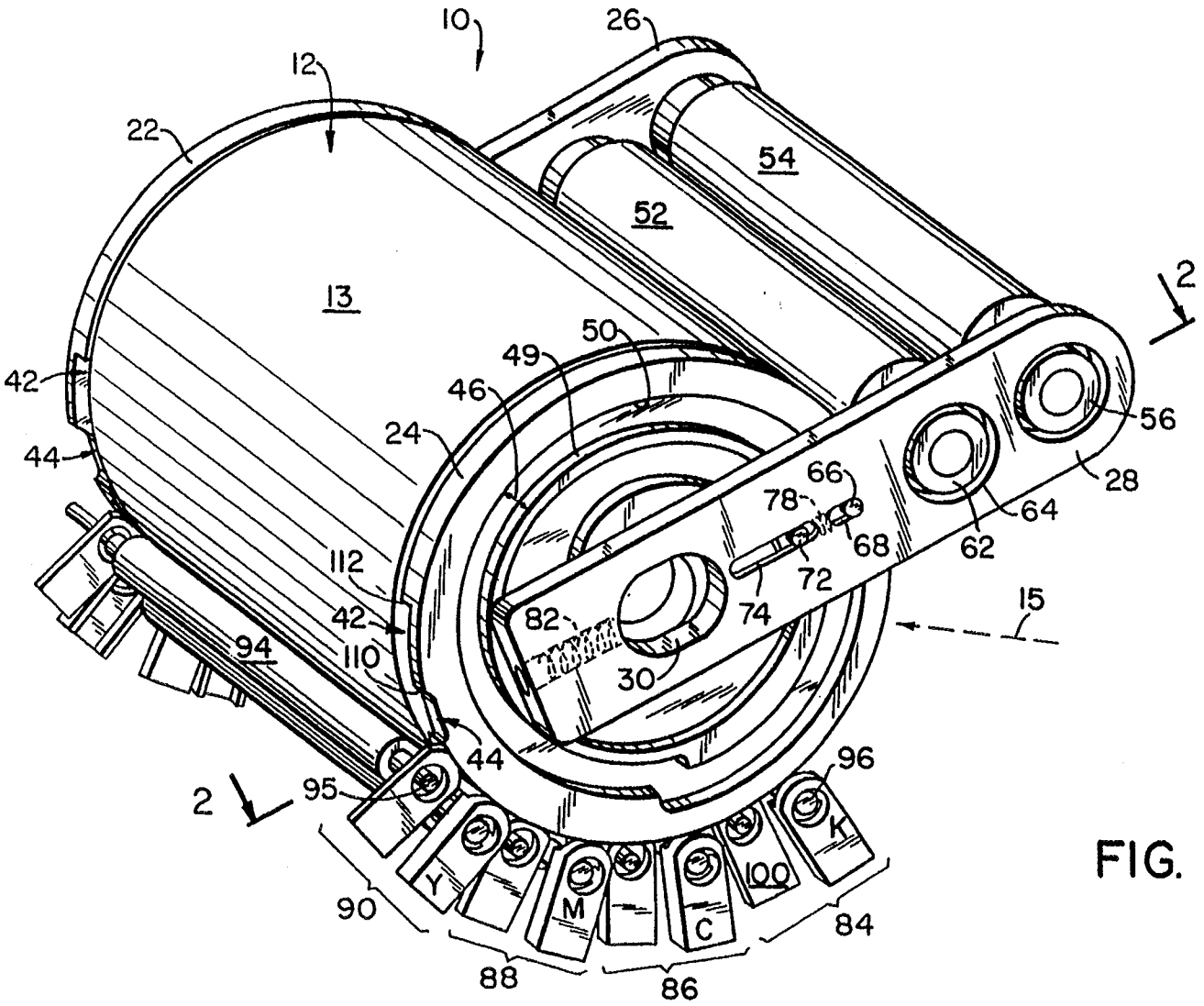
FIG. 1 is a perspective view of a portion of an EP printer that incorporates the invention hereof.
Figure 2:
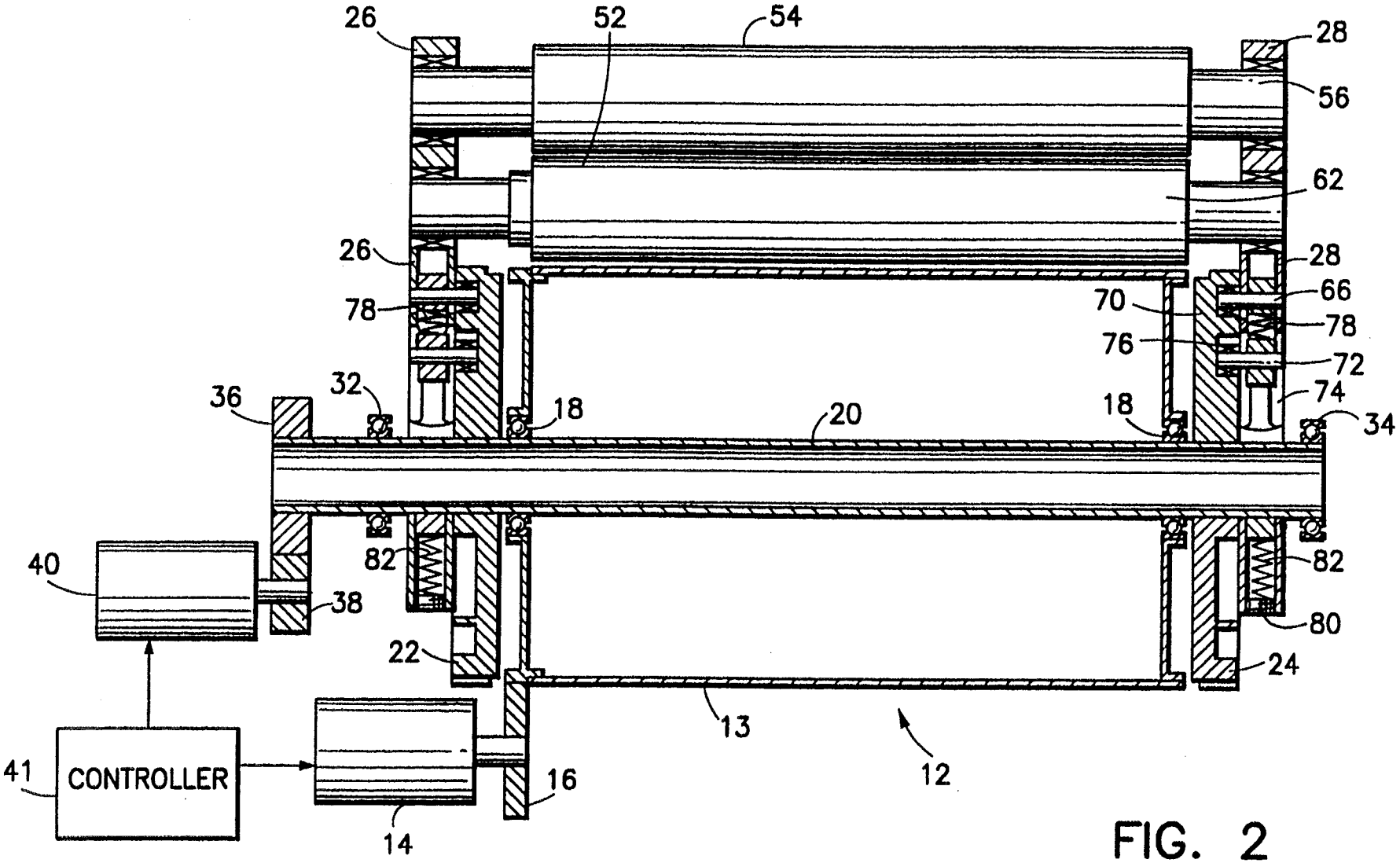
FIG. 2 is a partial sectional view, taken along line 2—2 in FIG. 1.
Figure 3:
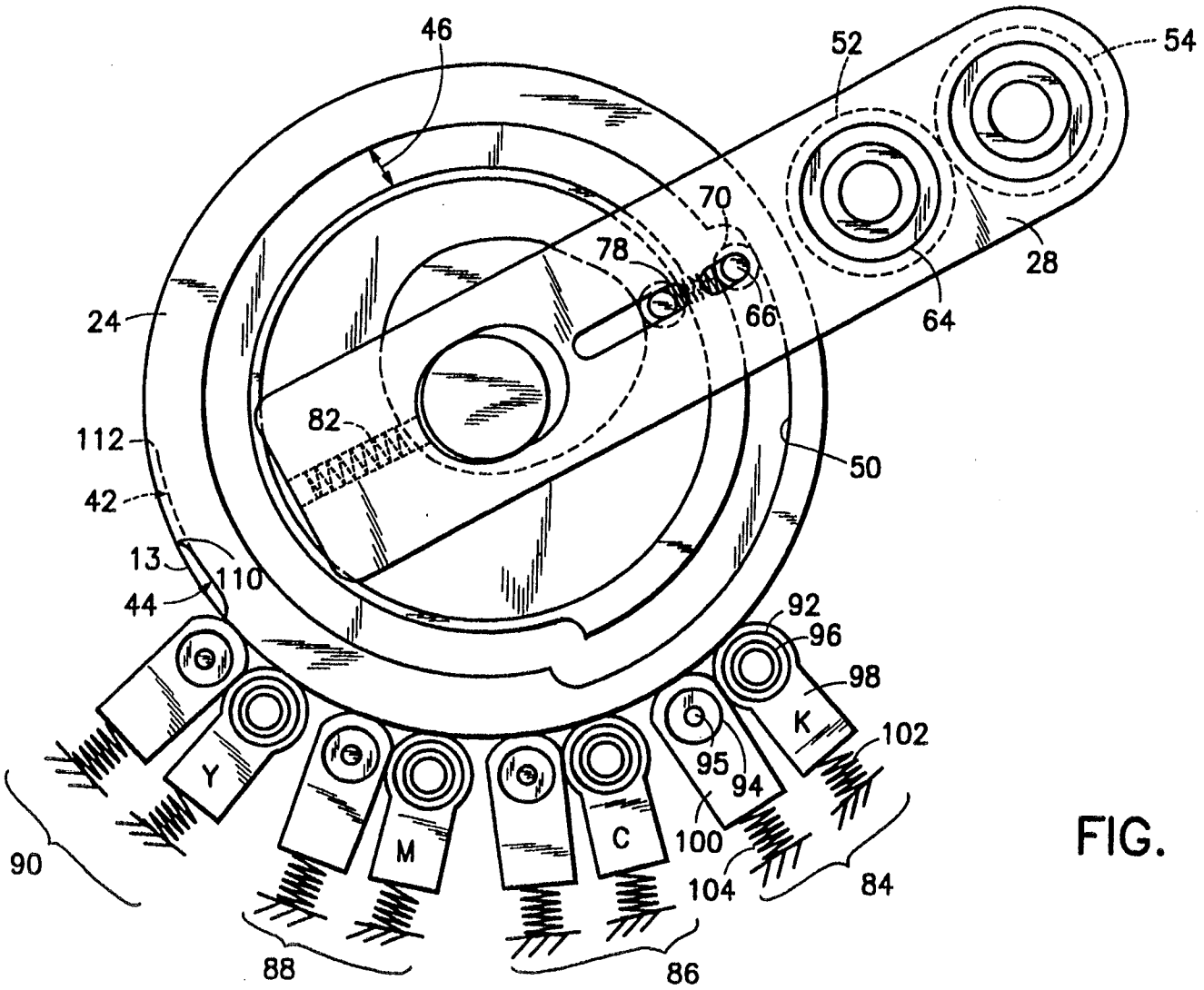
FIGS. 3–10 are schematic side views of the EP printer mechanism of FIG. 1, at sequential stages of rotation of controlling cam plates attached to the ends of a photoconductor-containing drum.
Figure 4:
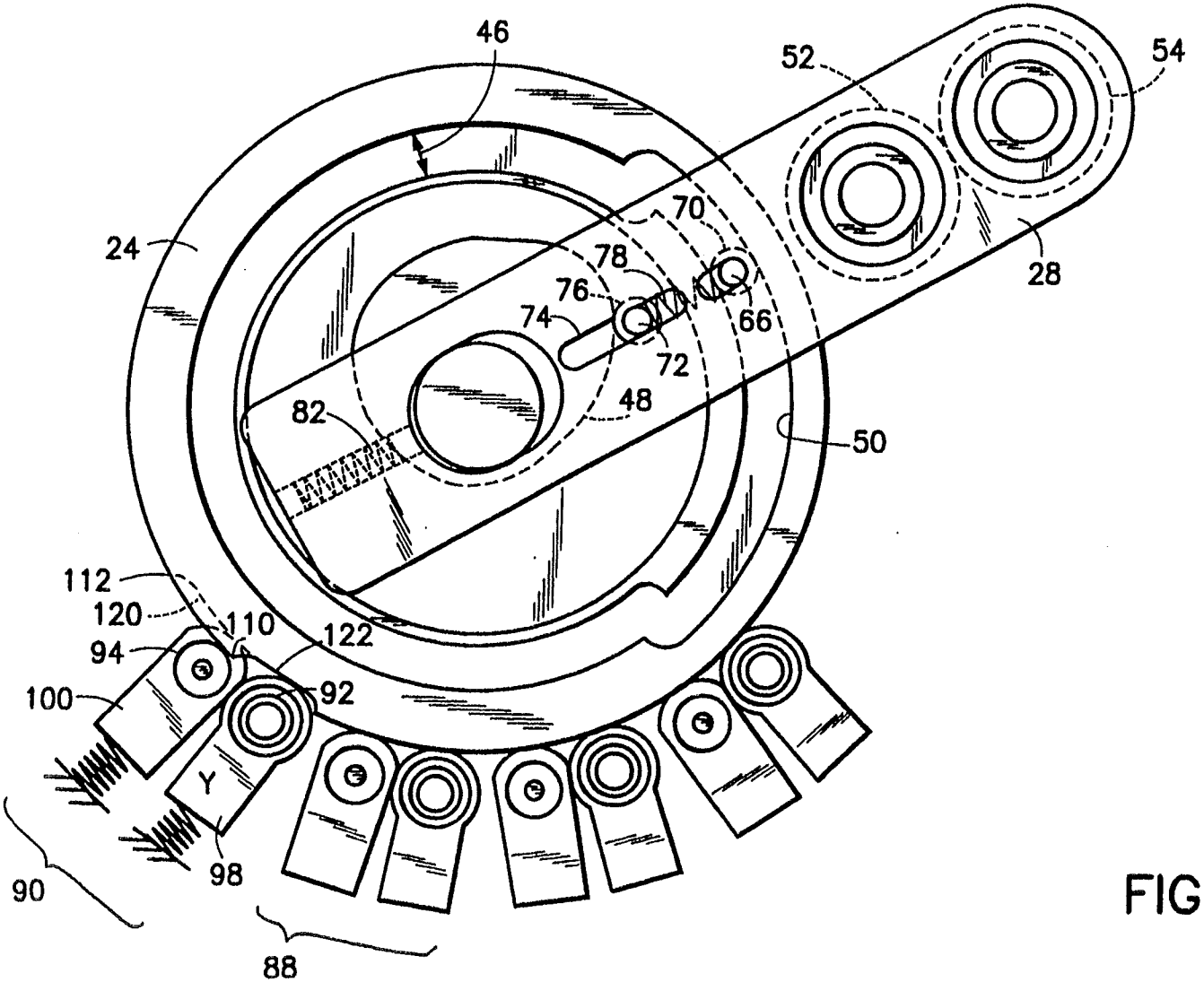
Figure 5:
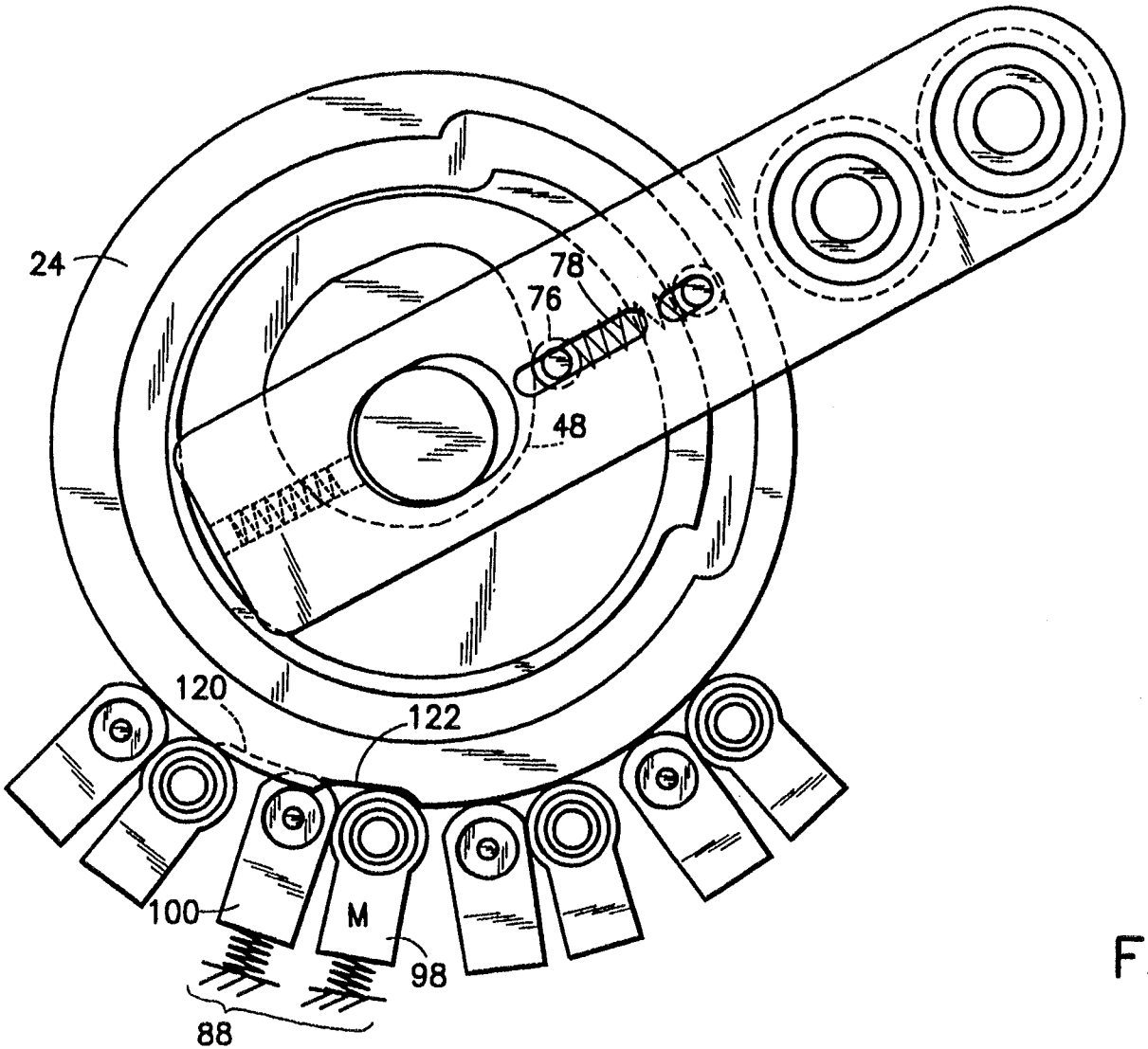

Referring now to FIGS. 1 and 2, a partial EP printer mechanism 10 is shown. Various stations not necessary to an understanding of the invention have been omitted (such as a corona erase station, etc.). The mechanism includes a drum 12 with a photoconductor surface 13. Drum 12 is rotated in a clockwise direction by a drive motor 14 and gear 16 that engages an outer gear track on drum 12 (shown in FIG. 2). Drum 12 is mounted on bearings 18 which enable its rotation about axle 20 under control of drive motor 14. In the known manner, a laser beam 15 image-wise exposes photoconductor surface 13.

A pair of cam plates 22 and 24 are positioned at opposed ends of drum 12 and are rigidly mounted to axle 20 for rotation therewith. A pair of link arms 26 and 28 include follower mechanisms (to be described in detail below) which engage tracks within cam plates 22 and 24, respectively. Each of link arms 26 and 28 includes an elongated opening 30 through which axle 20 is enabled to pass without interference. Axle 20 is not shown in FIG. 1. Axle 20 is mounted on bearings 32 and 34 which are, in turn, coupled to the printer chassis. A gear 36 is positioned at one end of axle 20 and mates with a gear 38 that is, in turn, operated by drive motor 40. A controller 41 operates both motors 14 and 40 under control of a microprocessor (not shown) in the EP printer. Drive motor 40 is operated to cause axle 20 to rotate in a direction that is counter to the direction of rotation of drum 12, thus causing cam plates 22 to counter-rotate when considering the rotation direction of drum 12.

Returning to FIG. 1, the structure and operation of cam plate 24 will be described, it being understood that cam plate 22 is identical thereto, but a mirror image thereof. Cam plate 24 includes four cam profiles, to wit: a squeegee roller profile 42, a developer roller profile 44, a link arm control profile 46 and an energy storage profile 48. Link arm control profile 46 includes an inner race 49 and an outer race 50, which, together, aid in actuation of both a transfer roller 52 and a pressure roller 54.

Pressure roller 54 is mounted on an axle 56 which is, in turn, rigidly mounted in bearings (not shown) within link arms 26 and 28, respectively. Image transfer roller 52 is mounted on a shaft 62 and is supported by bearings (not shown) which ride in oblong slot 64 in both of link arms 26 and 28. As will become hereafter apparent, link arms 26 and 28 are controlled by a combination of followers and engaged springs to move the combination of pressure roller 54 and transfer roller 52 out of and into engagement with photoconductor surface 13. When link arms 58 and 60 are simultaneously operated to move leftward (as shown in FIG. 1), pressure roller 54 is similarly moved leftward and causes transfer roller 52 to engage photoconductor surface 13. By contrast, when link arms 58 and 60 are moved rightward, pressure roller 54 first disengages from transfer roller 52 (which remains somewhat stationary due to the oblong shape of slot 64 in link arms 58 and 60). Next, the bearings surrounding shaft 62 contacts a leftmost inner surface of oblong slot 64 and cause transfer roller 52 to the move rightward, thereby causing it to disengage from photoconductor surface 13.

Link arms 26 and 28 are coupled to link arm control profile 46 and energy storage profile 48 by a pair of follower mechanisms, the engagement pin portions thereof being visible in FIG. 1. A control follower pin 66 rides in a slot 68 and, in addition, connects to a control follower roller 70 (see FIG. 1) which rides between inner and outer races 49, 50 of link arm control profile 46. In a similar fashion, an energy storage follower pin 72 rides in an elongated slot 74 and connects to an energy storage follower roller 76 (see FIG. 2). A compression spring 78 biases energy storage follower pin 72 away from control follower pin 66.

At the leftmost extremity of link arms 26 and 28 is an internal hole which contains a transfer engagement spring 82 that bears against the outer periphery of axle 20. As will be understood from the description below, transfer engagement spring 82 causes, during a portion of the rotation cam plates 22 and 24, a leftward forcing of link arms 26 and 28 to cause transfer roller 52 to come into engagement with the photoconductor surface 13. At other times during the rotation of cam plates 22 and 24, control follower pin 66 and control follower 70 act upon link arms 26, 28, to maintain transfer roller 52 in a disengaged state. The operation of control follower pin 66 and control follower 70 is, in turn, controlled by the action of transfer disengage spring 78 whose energy state is, in turn, controlled by energy storage follower pin 72 and energy storage follower 76. The detailed operation of the aforesaid mechanism will be considered during the description of FIGS. 3–10.

As EP printer 10 is a color printer, it is provided with four developer modules 84, 86, 88 and 90, which, respectively, contain black, cyan, magenta and yellow liquid toners. The housing which surrounds each of the developer modules has been removed, as has the necessary plumbing required to supply the liquid toner to the nips between the developer rollers and photoconductor surface 13. Each developer module is identical in structure and includes a developer roller 92 (see FIG. 3) and a squeegee roller 94. Each developer roller 92 is mounted on a shaft 96 that is coupled by bearings (not shown) to a pair of developer roller supports 98. In a similar fashion, each squeegee roller 94 is mounted on a shaft 95 which is coupled by a set of bearings (not shown) to a pair of squeegee roller supports 100. Springs 102 and 104, respectively, bias bearing surfaces of developer roller support 98 and squeegee roller support 100 against developer roller profile 44 and squeegee roller profile 42 on cam plates 22 and 24.

Incremental rotation of cam plates 22 and 24 (and squeegee roller profile 42 and developer roller profile 44) enable developer and squeegee rollers 92, 94, from each of developer modules 84, 86, 88 and 90, to be sequentially brought into engagement with photoconductor surface 13. It will be recalled that drum 12 rotates in one direction (e.g. clockwise) while cam plates 22 and 24 are incremently stepped in an opposite direction (e.g. counterclockwise). Examination of squeegee roller profile 42 will show that counterclockwise movement of cam plates 22 and 24 enables each squeegee roller 94 to contact photoconductor surface 13 on clockwise-moving drum 12 before developer roller profile 44 allows a developer roller 92 to contact photoconductor surface 13.

In a similar manner, a continued rotation of developer roller profile 44 causes a high point 110 to interact with the bearing surface of developer roller support 98 and to lift the associated developer roller 92 out of contact with photoconductor surface 13 before highpoint 112 interacts with squeegee roller support 100 to cause an associated squeegee roller 94 to disengage from photoconductor surface 13. As a result, squeegee roller profile 42 assures that each squeegee roller 94 is in contact with photoconductor surface 13 both before and after an associated developer roller 92 is in contact with photoconductor surface 13.

As will be recalled, printer mechanism 10 is a color printer and employs four liquid toner developer modules 84, 86, 88 and 90 to selectively tone imaged areas on photoconductor surface 13. The operating cycle of the system is as follows. Laser beam 15 is modulated to first expose photoconductor surface 13 with pixel images from a yellow color plane. Drum 12, which constantly rotates clockwise, causes the beam-imaged areas to pass yellow developer module 90. Prior to the imaged areas arriving at developer module 90, cam plates 22, 24 are rotated counterclockwise to bring the low portions of squeegee roller profile 42 and developer roller profile 44 into engagement with squeegee roller support 100 and developer roller support 98 of developer module 90. As a result squeegee roller 94 and developer roller 92 are enabled to engage photoconductor surface 13 and allow a toning of the yellow-plane exposed areas.

After yellow development, drum 12 continues to rotate and photoconductor surface is imaged by laser beam 15 in accordance with data from a magenta image plane. Cam plates 22, 24 are rotated further counterclockwise by approximately 25° to bring the low portions of squeegee roller profile 42 and developer roller 44 into contact with magenta developer module 88 so as to enable magenta development. Identical actions sequentially occur with respect to cyan and black developer modules 86 and 84, to enable development of areas imaged in accord with cyan and black color image planes.

After black image plane development, cam plates 22, 24 are rotated further counter clockwise to enable link arms 26, 28, under control of transfer engagement springs 82, control followers 70, energy storage followers 76 and transfer disengage springs 78, to bring transfer roller 52 into contact with photoconductor surface 13. This action enables transfer of the fully toned image to transfer roller 52 and from thence to a media sheet that is fed between transfer roller 52 and pressure roller 54. Thereafter, the cycle repeats.

Turning now to FIGS. 3–10, the operation of the mechanism shown in FIGS. 1 and 2 will be described in relation to a four color print cycle. As will be recalled, cam plates 22 and 24 are incremented in a counterclockwise direction, while drum 12 rotates in a clockwise direction. Hereafter, only the action of cam plate 24 and arm link 28 will be described, but it is to be understood that identical actions occur concurrently at cam plate 22. At the position of cam plate 24 shown in FIG. 3, control follower 70 has just passed to an outermost portion of link arm control profile 46. That action has enabled transfer disengage spring 78 to expand, thereby causing control follower pin 66 and control follower 70 to contact outermost race 50 of link arm control profile 46. That action enables pin 66 to engage the outmost portion of slot 68 (see FIG. 1) which, in turn, pushes link arm 28 outwardly. The expansion of transfer disengage spring 78 overcomes the counter force exerted by transfer engage spring 82 and causes compression thereof. The outward movement of link arm 28 moves pressure roller 54 outward, thereby releasing pressure on transfer roller 52. Near the end of the movement of link arm 28, an innermost surface of oblong slot 64 engages the bearing about axle 62 and, in turn, moves transfer roller 52 out of contact with the photoconductor surface 13. At this stage, neither squeegee roller profile 42 nor developer roller profile 44 has reached a developer module.

Assuming that photoconductor surface 13 is being exposed in accord with yellow image plane data, cams 22, 24 are incremented counterclockwise to enable squeegee roller support 100 to move into depression 120 of squeegee roller profile 42, thereby bringing squeegee roller 94 into contact with photoconductor surface 13. Shortly thereafter, developer roller support 98 moves into depression 122 in developer roller profile 44 thereby bringing developer roller 92 into contact with photoconductor surface 13. At this stage, yellow toner is applied at the nip of developer roller 92 and photoconductor surface 13 to tone the yellow plane-exposed portions of photoconductor surface 13.

The rotation of cam plate 24 also enables some expansion of transfer disengage spring 78 due to the fact that energy storage follower assembly 76 is starting to ride down on energy storage profile 48. It will be recalled that the travel of energy storage follower assembly 76 is radially constrained by the engagement between pin 72 and slot 74. Even though the compression of transfer disengage spring is lessened, link arm 28 is prevented from moving inwardly by the confining action of transfer control profile 46 on transfer control follower 70 and interference between an outermost portion of slot 68 and pin 66.

Drum 12 continues its clockwise motion, causing the entire yellow-imaged area on photoconductor 13 to pass by developer 90. During a portion of this time, photoconductor 13 is being again imaged, under control of data from a magenta image plane. Before the magenta imaged areas reach magenta developer module 88, cam plate 24 is incremented counterclockwise to bring low portions 120 and 122 of squeegee roller profile 42 and developer roller profile 44 into contact with magenta developer module 88 (see FIG. 5). A magenta toning action is thus enabled.

Figure 6:
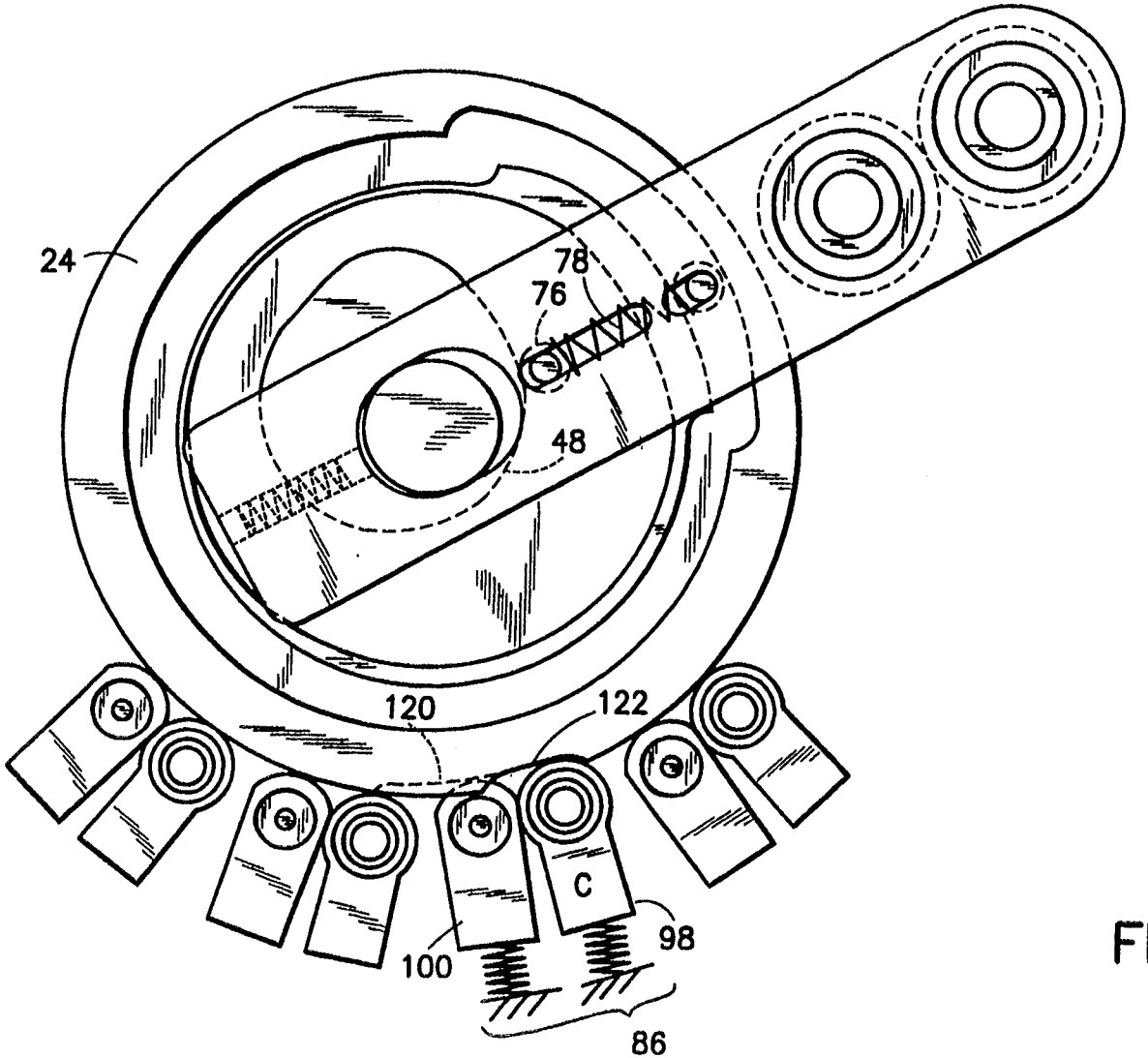
Figure 7:
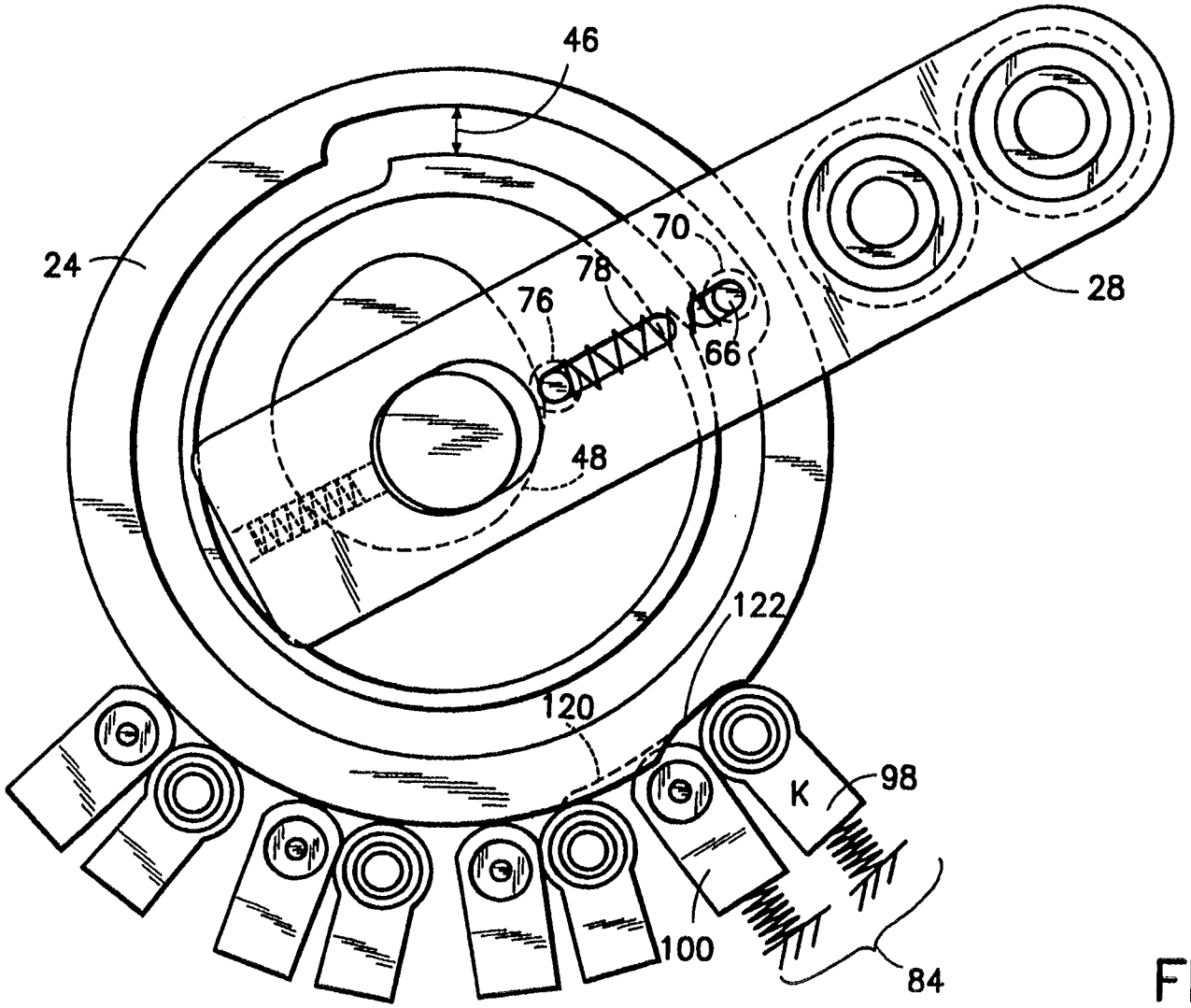

The above described actions continue, as shown in FIGS. 6 and 7, whereby cyan and black developer modules 86 and 84 are sequentially enabled to contact photoconductor surface 13. Further during this sequence of operations, energy storage follower 76 continues its movement down energy storage profile 48, further releasing transfer disengage spring 78 from compression. During this time, there is no change in the compression of transfer energy spring 82 due to the confining action of link arm control profile 46 on control follower 70 (as translated to link arm 28 by pin 66).

Figure 8:
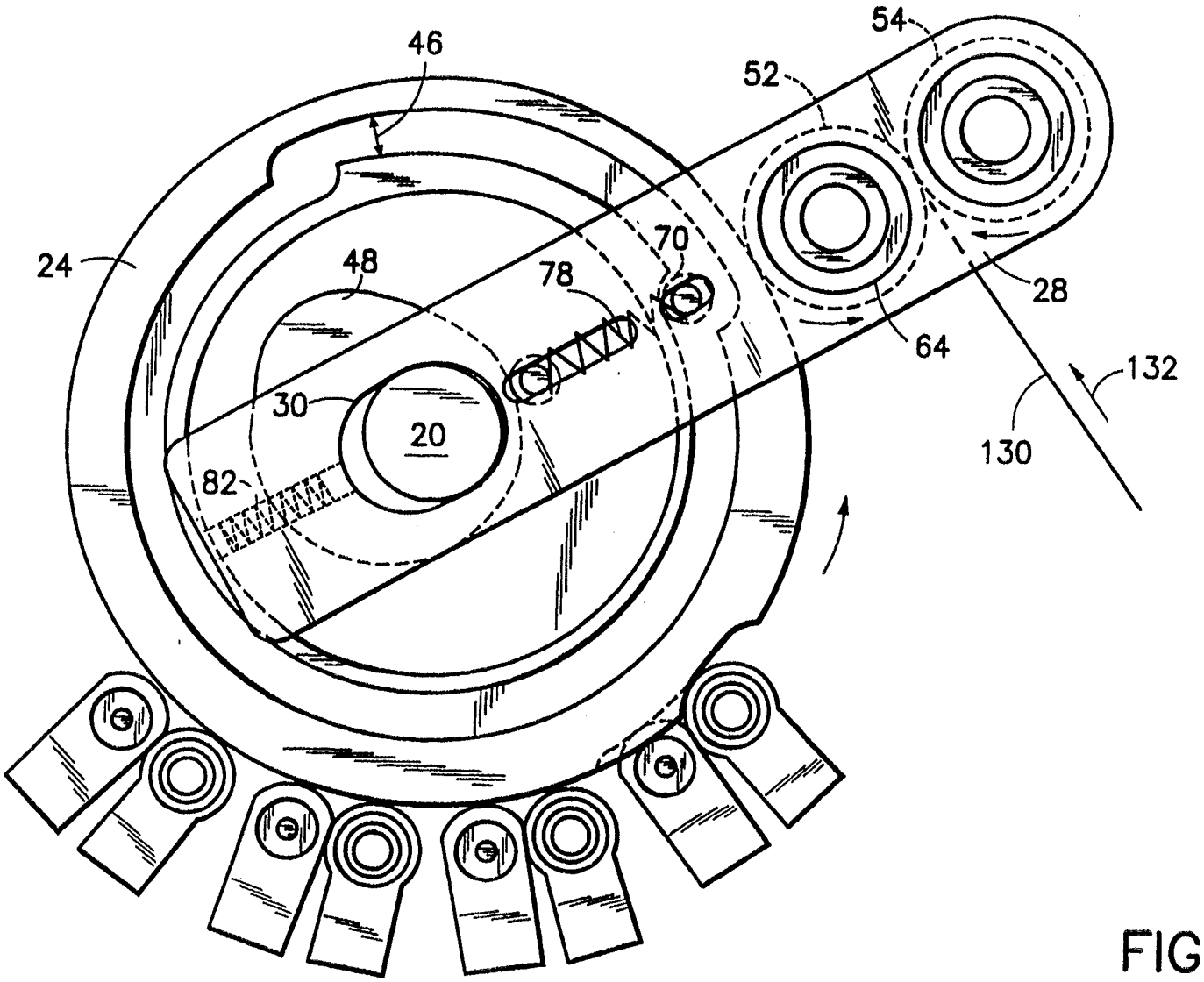

After black toning is completed (FIG. 7), cam plate 24 is further incremented counterclockwise to enable control follower 70 to fall into an innermost portion of link arm control profile 46 (see FIG. 8). That action and the full expansion of transfer disengage spring 78 enables transfer engage spring 82 to expand and to move link arm 28 in an inward direction. That movement brings pressure roller 54 into contact with transfer roller 52 and causes a pressure engagement with photoconductor surface 13. At this time, a toner transfer action occurs from photoconductor surface 13 to transfer roller 52 and to a media sheet 130 passing between pressure roller 54 and transfer roller 52 in the direction shown by arrow 132.

Figure 9:
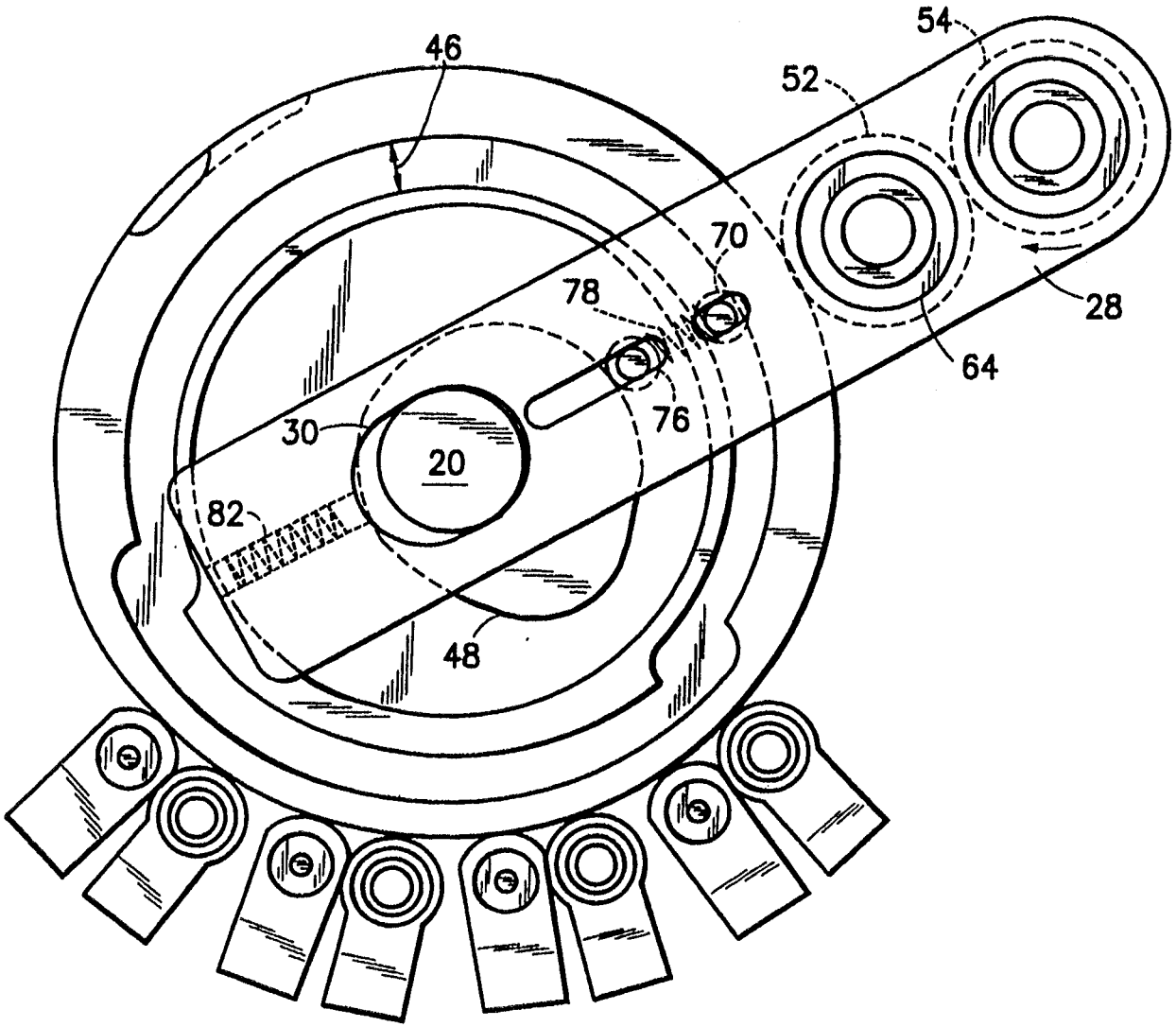
Figure 10:
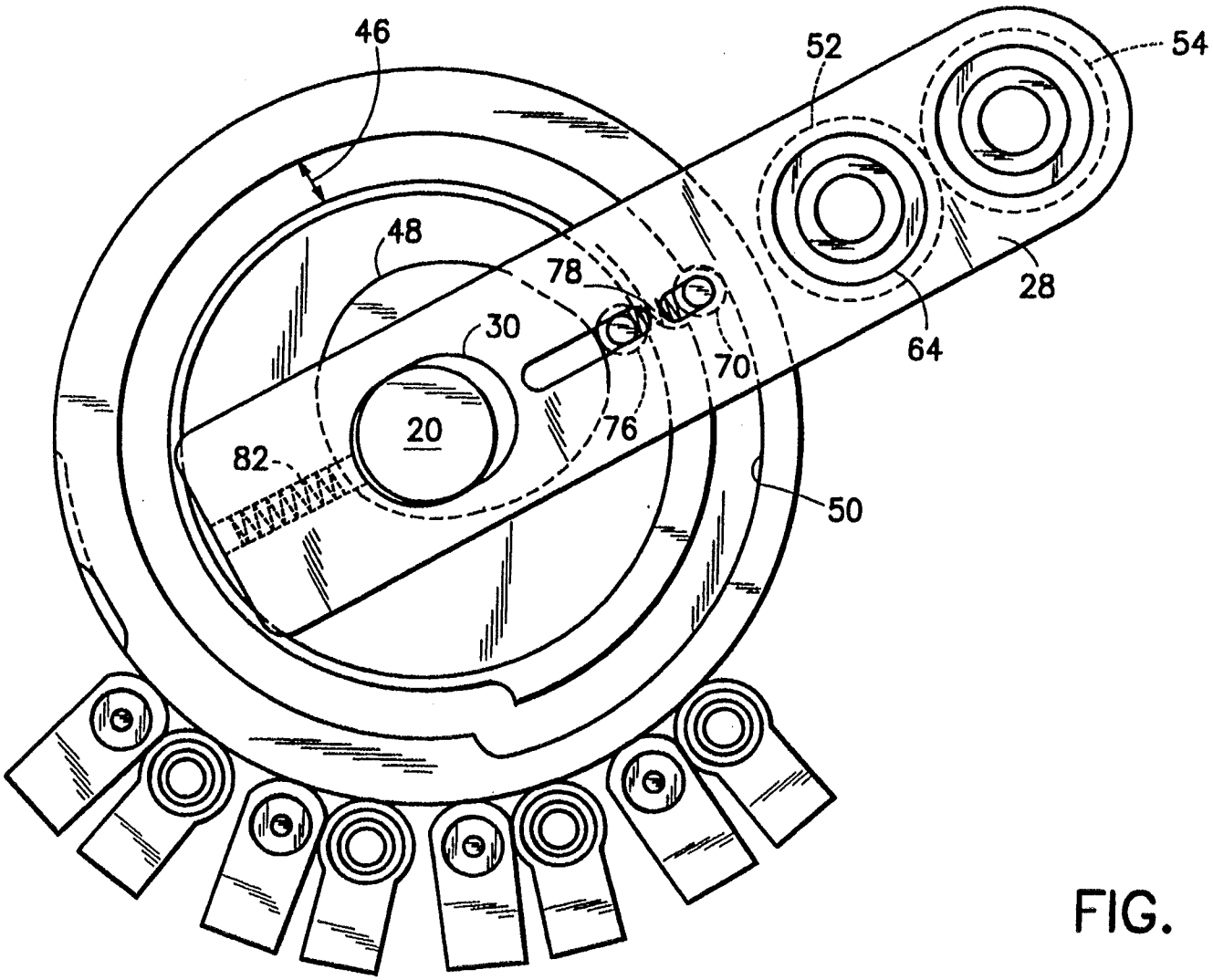

As shown in FIG. 9, a further rotation of cam plate 24 enables energy storage profile 48 to commence moving energy storage follower 76 in an outward direction, thereby compressing transfer disengage spring 78. This action continues until, as shown in FIG. 10, control follower 70 moves into the outermost portion of link arm control profile 46 and contacts outer race 50. This action enables transfer disengage spring 78 to overcome the compression force exerted by transfer engage spring 82 and to again move link arm 28 outward, enabling disengagement of transfer roller 52 and pressure roller 54 from photoconductor surface 13.

As can thus be seen from the above description, cam plates 22 and 24 and link arms 26, 28 completely control the engagement and disengagement of all four developer modules and the transfer roller mechanism.

The above description of the invention has presumed its use as a full color printer wherein the photoconductor is fully toned (requiring four revolutions of drum 12) before transfer roller 52 is brought into contact. At times, it may be desired to operate EP printer mechanism 10 as a black/white monochrome printer. In such case, cam plates 22 and 24 are held stationary in the position shown in FIG. 8, for the duration of the entire printing action. Thus laser beam 15 exposes an image on photoconductor 13 which is then developed at black developer module 84 (which is continuously engaged). The developed image is then transferred by transfer roller 52 which is also continuously engaged. Thus, for every revolution of drum 12, there is a black monochrome page printed and no actuation of cam plates 22, 24 is required. This print action occurs at a rate that is four times faster than the rate of color printing.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrophotographic (EP) printer comprising:

a drum having a photoconductor surface, opposed ends, and mounted for rotation on an axle;

motor means for rotating said drum;

transfer roller means;

arm links positioned at said opposed ends for supporting said transfer roller means adjacent said photoconductive surface, each arm link including engagement spring means for biasing a respective arm link in a direction to bring said transfer roller means into engagement with said photoconductor surface;

cam plates positioned at said opposed ends, each cam plate having plural cam paths including a transfer control cam path and an energy storage cam path;

arm link follower means coupled between said arm links and each said transfer control cam path;

energy storage follower means coupled between said arm links and each said energy storage cam path;

disengagement spring means for biasing said arm link follower means into engagement with each said transfer control cam path and tending to move said transfer roller means out of contact with said photoconductor surface; and motive means for rotating said cam plates (i) by a first distance to cause said arm link follower means, under control of said transfer control cam paths and said disengagement spring means, to bring and maintain said transfer roller means out of contact with said photoconductor surface, and (ii) by a second distance wherein each said transfer control cam path enables said arm link follower means to be controlled by said disengagement spring means, causing movement of said arm links and bringing said transfer roller means into contact with said photoconductor surface.

2. The EP printer as recited in claim 1, wherein said cam plates further include squeegee roller cam tracks and developer roller cam tracks, both said squeegee roller cam tracks and developer roller cam tracks including actuation regions, said EP printer further comprising:

at least one developer means including a squeegee roller means engaged with said squeegee roller cam tracks and developer roller means engaged with said developer roller cam tracks, whereby rotation of said cam plates brings said actuation regions of said squeegee roller cam tracks and said developer roller cam tracks into engagement with said squeegee roller means and developer roller means, respectively, to enable engagement thereof with said drum.

3. The EP printer as recited in claim 2, wherein a plurality of developer means are positioned about said drum and in engagement with said squeegee roller cam tracks and developer roller cam tracks, said EP printer further comprising:

controller means for energizing said motive means to incrementally position said actuation regions into engagement with a sequential one of said developer means, once per rotation of said drum.

4. The EP printer as recited in claim 3, wherein said controller means, after positioning of said actuation regions in contact with a last one of said developer means, then causes said motive means to rotate said cam plates by said second distance to position said actuation regions in juxtaposition to a first one of said developer means, rotation of said cam plates by said second distance enabling said arm link follower means, under control of said disengagement spring means, to enter a lesser diameter portion of said transfer control cam paths to maintain said transfer roller means in engagement with said photoconductor surface.

5. The EP printer as recited in claim 4, wherein said transfer roller means comprises:

a pressure roller mounted for rotation on a pressure roller axle; and a transfer roller mounted for rotation on a transfer roller axle and positioned between said pressure roller and said photoconductor surface of said drum.

6. The EP printer as recited in claim 5, wherein said pressure roller is mounted between said arm links and said transfer roller is also mounted between said arm links, but the mounting of said transfer roller enables translation thereof along said arm links, whereby movement of said arm links by said disengagement spring means causes said pressure roller to move said transfer roller into engagement with said photoconductor surface.

7. The EP printer as recited in claim 6, wherein said transfer roller is mounted in elongated openings in said arm links, said elongated openings engaging the axle of said transfer roller to cause it to move out of contact with said photoconductor surface upon action of said disengagement spring means in combination with said arm link follower means.

8. The EP printer as recited in claim 3, further comprising:

controller means for causing said motive means to rotate said cam plates to a position within said second distance wherein said actuation regions are in engagement with one developer means and for disabling said motive means from further movement so as to enable a single color printing action by said one developer means.

9. The EP printer as recited in claim 1, wherein said motor means rotates said drum in a first direction and said motive means rotates said cam plates in an opposite direction.

10. The EP printer as recited in claim 1, wherein said rotation of said cam plates by said second distance enables said energy storage follower means, in combination with said energy storage cam path, to add energy to said disengagement spring means and to enable said disengagement spring means to overcome a force exerted by said disengagement spring means and to move said arm links and transfer roller means out of engagement with said photoconductor surface.

* * * * *